US009724554B2

(12) United States Patent
Burkinshaw

(10) Patent No.: US 9,724,554 B2
(45) Date of Patent: Aug. 8, 2017

(54) FULL BODY EXERCISE APPARATUS

(71) Applicant: Colin M Burkinshaw, Pflugerville, TX (US)

(72) Inventor: Colin M Burkinshaw, Pflugerville, TX (US)

( * ) Notice: Subject to any disclaimer, the term of this patent is extended or adjusted under 35 U.S.C. 154(b) by 49 days.

(21) Appl. No.: 14/690,452

(22) Filed: Apr. 19, 2015

(65) Prior Publication Data

US 2015/0297937 A1 Oct. 22, 2015

Related U.S. Application Data

(60) Provisional application No. 61/982,022, filed on Apr. 21, 2014.

(51) Int. Cl.
*A63B 21/00* (2006.01)
*A63B 21/068* (2006.01)
(Continued)

(52) U.S. Cl.
CPC ..... *A63B 21/068* (2013.01); *A63B 21/0552* (2013.01); *A63B 23/12* (2013.01); *A63B 23/1218* (2013.01); *A63B 71/02* (2013.01); *A63B 21/00043* (2013.01); *A63B 21/00069* (2013.01); *A63B 21/00181* (2013.01); *A63B 21/00185* (2013.01); *A63B 21/0442* (2013.01); *A63B 21/0555* (2013.01); *A63B 21/0557* (2013.01); *A63B 21/16* (2013.01); *A63B 21/4009* (2015.10); *A63B 21/4035* (2015.10); *A63B 23/0227* (2013.01); *A63B 23/0233* (2013.01); *A63B 23/1245* (2013.01); *A63B 23/1281* (2013.01); *A63B 69/004* (2013.01); *A63B 69/0028* (2013.01); *A63B 69/0048* (2013.01); *A63B 71/0009* (2013.01); *A63B 71/0054* (2013.01); *A63B 2023/003* (2013.01); *A63B 2023/006* (2013.01);
(Continued)

(58) Field of Classification Search
CPC ..... A63B 21/0552; A63B 21/0557; A63B 21/4025; A63B 21/0442; A63B 21/4011; A63B 21/4009; A63B 23/03541; A63B 21/4043; A63B 21/4017; A63B 21/4007; A63B 21/4015; A63B 21/4035; A63B 21/00069; A63B 2209/10; A63B 21/00185; A63B 21/00043; A63B 21/02; A63B 21/0555; A63B 21/4019; A63B 21/0004; A63B 23/03575
USPC ..... 482/124
See application file for complete search history.

(56) References Cited

U.S. PATENT DOCUMENTS 3,458,188 A 7/1969 Infante
5,141,223 A 8/1992 Block
(Continued)

FOREIGN PATENT DOCUMENTS

EP 0344723 B1 3/1989

*Primary Examiner* — Andrew S Lo
(74) *Attorney, Agent, or Firm* — ClearPat Services, LLC

(57) ABSTRACT

A layered strap-like apparatus for exercising, stretching and training multiple muscle groups of the entire body of a user. The apparatus is adapted to be worn about the waist or carried as a bandolier about the user's body. The apparatus has an optional, releasably closable pocket between the layers for securing and carrying accessories, such as attachable handles and elastic bands. The apparatus and methods of use provide the user with balanced loading options and the flexibility to exercise anywhere.

18 Claims, 6 Drawing Sheets

(51) Int. Cl.

| | |
|---|---|
| ***A63B 71/02*** | (2006.01) |
| ***A63B 23/12*** | (2006.01) |
| *A63B 21/055* | (2006.01) |
| *A63B 23/00* | (2006.01) |
| *A63B 69/00* | (2006.01) |
| *A63B 71/00* | (2006.01) |
| *A63B 21/04* | (2006.01) |
| *A63B 23/02* | (2006.01) |
| *A63B 21/16* | (2006.01) |

(52) U.S. Cl.

CPC ..... *A63B 2207/02* (2013.01); *A63B 2208/029* (2013.01); *A63B 2208/0214* (2013.01); *A63B 2209/02* (2013.01); *A63B 2209/10* (2013.01); *A63B 2210/50* (2013.01); *A63B 2220/12* (2013.01); *A63B 2225/54* (2013.01); *A63B 2225/685* (2013.01); *A63B 2244/08* (2013.01)

(56) References Cited

U.S. PATENT DOCUMENTS 5,158,510 A 10/1992 Lemire
5,336,151 A 8/1994 Van Ballegooie
5,433,688 A 7/1995 Davies
5,558,609 A * 9/1996 Olschansky ..... A63B 21/0552 482/122
5,618,249 A 4/1997 Marshall
5,647,827 A 7/1997 Gutkowski
5,716,307 A 2/1998 Vadher
5,743,838 A 4/1998 Willis
5,769,764 A 6/1998 Tilberis
5,792,034 A 8/1998 Kozlovsky
5,820,534 A 10/1998 Vadher
5,876,310 A 3/1999 Mackey
5,941,802 A * 8/1999 Kiser ..... A63B 1/00 482/129
5,993,362 A 11/1999 Ghobadi
6,837,834 B2 1/2005 Basting
7,041,040 B2 * 5/2006 Dovner ..... A63B 21/0004 482/124
7,104,935 B2 * 9/2006 Matsuoka ..... A63B 21/0004 482/121
7,207,931 B2 4/2007 Boland
7,316,636 B1 1/2008 Hinds
7,465,259 B2 * 12/2008 Mok ..... A63B 21/0004 482/121
7,727,131 B2 * 6/2010 Longo ..... A63B 21/4009 482/121
7,740,570 B2 * 6/2010 Winston ..... A63B 5/20 482/121
7,762,932 B2 * 7/2010 Hetrick ..... A63B 21/0023 482/904
7,854,694 B1 12/2010 Frunzi
7,955,236 B2 * 6/2011 DiGiovanni ..... A63B 21/0552 482/124
8,012,071 B2 * 9/2011 Grisdale ..... A63B 21/0004 482/122
8,033,966 B2 * 10/2011 Ayoub ..... A63B 23/1209 482/121
8,152,703 B1 * 4/2012 Hinds ..... A63B 21/00065 482/122
8,556,754 B2 10/2013 Roman
8,617,037 B2 12/2013 Dieter
8,876,679 B2 * 11/2014 DeMarco ..... A63B 1/00 482/129
8,932,191 B2 * 1/2015 Failer ..... A63B 21/008 482/112
2004/0127339 A1 * 7/2004 Finn ..... A63B 21/00181 482/140
2004/0157710 A1 * 8/2004 Basting ..... A63B 21/0004 482/126
2005/0113221 A1 5/2005 Dovner
2007/0015642 A1 1/2007 Demeniuk
2010/0279830 A1 * 11/2010 Snagg ..... A63B 21/0552 482/124
2012/0202658 A1 8/2012 Menefee, Sr.
2013/0045842 A1 2/2013 Wood
2013/0079201 A1 3/2013 Morgan
2013/0085046 A1 4/2013 Jolly
2013/0143724 A1 6/2013 DeMeo
2013/0203567 A1 * 8/2013 Thomas ..... A63B 21/4025 482/124
2013/0217547 A1 * 8/2013 Hinds ..... A63B 7/00 482/96
2014/0005015 A1 * 1/2014 Hester ..... A63B 21/154 482/131
2014/0073496 A1 * 3/2014 Bannerman ..... A63B 21/0552 482/139
2014/0155229 A1 * 6/2014 Nikkaran ..... A63B 21/068 482/99
2014/0200499 A1 * 7/2014 Champion ..... A63B 21/151 602/36
2015/0251039 A1 * 9/2015 Mikulski ..... A63B 21/0442 482/126

* cited by examiner

FULL BODY EXERCISE APPARATUS

CROSS-REFERENCE TO RELATED APPLICATIONS

This application claims the benefit of U.S. Provisional Application No. 61/982,022, filed Apr. 21, 2014, which application is incorporated herein by reference.

BACKGROUND OF THE INVENTION

The present invention relates to exercise equipment. More specifically, the present invention relates to an exercise system that provides the user with a portable exercise assistance apparatus.

Some specialized exercise programs incorporate accessory devices to add strength and flexibility options and to further expand the exercise program. Unfortunately, due to their bulk, most of these accessories are quite heavy, difficult to transport and limit their use to a restricted location such as a fitness gym, which in turn limits the general utility of such exercise programs.

SUMMARY OF THE INVENTION

Many exercise enthusiasts feel claustrophobic with the indoor fitness gym environment and wish to take their exercise programs outdoors, but feel limited by the lack of available portable equipment. Some "hard core" enthusiasts have even gone so far as to make use of existing structures and creating exercise sports such as Parkour, Freerunning, Buildering, spelunking, rock climbing, urban rock climbing, and Plyometrics, also known as "jump training" or "plyos", in an attempt to combine their running and aerobic exercise with strength training.

However, not every "weekend athlete" can train as intensely or has access to the training protocols or facilities utilized by many of these hard core athletes. So, there remains a need for a portable apparatus that is light weight, easy to use, and easily transportable that provides the exercise enthusiast, or those who prefer not to be restricted to a gym environment with a system that can add variety to their routine and allow them to have a gym fitness experience while exercising anywhere.

In various embodiments illustrated and described herein, is a versatile, lightweight and durable exercise apparatus for exercising multiple muscle groups of the entire body. The exercise apparatus comprises a layered strap or strap-like apparatus adapted to be worn about the waist, carried across the chest of the user's body as a bandolier, or simply carried and stored in a gym bag. The apparatus comprises a pocket for securing and carrying exercise accessories such as releasable handles, and elastic bands, among other attachments, attachable to multiple fixation points located at various points about the strap-like apparatus. The apparatus and described methods of use provide the user with balanced loading options to develop and improve muscle strength, flexibility and tone while providing the user with the flexibility to exercise anywhere that is convenient to the user.

The apparatus can be worn or carried anywhere by the user and can provide an outdoor enthusiast with portable exercise equipment to perform balanced resistance and tension training utilizing a coupled non-elastic band, elastic bands, and detachable and affixed flexible handles used in various exercise protocols and therapeutic applications.

Further, the apparatus is adaptable for use as a physical therapy device to be utilized by physically compromised individuals or individuals recovering from injury. Additionally, the device can be utilized by individuals with limited physical capacity due to age, handicap or health concerns as part of regular health maintenance program. Further still, the apparatus can be incorporated into conventional programs such as yoga, aerobics, kickboxing, martial arts or similar exercise regimens to add additional strength and stretching dimensions to such programs.

Provided herein is an exercise apparatus comprising a strap-like apparatus or strap-like belt adapted to be worn about the user's body, wherein the strap-like apparatus or strap-like belt comprises at least a first layer and a second layer, wherein the first layer comprises a first inside surface and a first outside surface, and the second layer comprises a second inside surface and a second outside surface; a pocket or pockets between the first inside surface and the second inside surface, which can be continuous or segregated into two or more compartment-like pockets; a connector strap comprising a first end and a second end and affixed to the outside surface or inside surface of the first layer, wherein the connector strap comprises a coupling mechanism for releasably securing the first end and second end of the connector strap to each other; a first handle and a second handle permanently or temporarily affixable to the connector strap or directly to the outside of the apparatus, wherein each handle is spaced approximately equidistant from the lengthwise center of the layered strap-like apparatus; a first fixation point affixed adjacent to the first end of the strap-like apparatus, extending outside of the pocket; and a second fixation point affixed adjacent to the second end of the strap-like apparatus, extending outside of the pocket; wherein the first and second fixation points are affixed between the first and second layers and to the connector strap or are affixed directly to the connector strap.

In some embodiments, the device comprises a third layer, wherein the third layer comprises a third inside surface and a third outside surface. In some embodiments, the third layer is an extension of the first layer and folds over the second layer to enclose the at least one pocket between the first inside surface and the second inside surface.

In some embodiments, the layers are formed from a single piece of folded material. In some embodiments, the layers are formed from two or more pieces of material and joined along their lengthwise edges.

In some embodiments, the exercise apparatus comprises a third fixation point affixed to the connector strap and through the approximate lengthwise center of the strap-like apparatus and accessible through at least one access point in the layers of the strap-like apparatus.

In some embodiments of the exercise apparatus, the at least one pocket is at least partially closable along the lengthwise edge.

In some embodiments of the exercise apparatus, the at least one pocket is at least partially closable at the first longitudinal end and/or the second longitudinal end.

In some embodiments of the exercise apparatus, the first longitudinal end and/or the second longitudinal end of the at least one pocket are at least partially closed with a permanent fixation means. In some embodiments, the permanent fixation means comprise thread; rivets; heat bonding materials; and glues or epoxies.

In some embodiments, the exercise apparatus comprises a fourth fixation point affixed adjacent to the first end of the strap-like apparatus and a fifth fixation point affixed adjacent to the second end of the strap-like apparatus, near the first and second fixation points, wherein the fourth and fifth fixation points are affixed between the first and second layers, within the at least one pocket, and to the connector strap and are accessible from the inside of the at least one pocket.

In some embodiments of the apparatus, the two or more segregated compartment-like pockets are closable along a lengthwise edge. In some embodiments of the apparatus, the two or more segregated compartment-like pockets are individually closable along a lengthwise edge.

In some embodiments of the apparatus, the two or more segregated compartment-like pockets are closable at a first end and a second end.

Further still, in some embodiments of the apparatus, a pocket which may be continuous, or comprising two or more segregated compartment-like pockets, are sewn closed at a first end or a second end, or both ends of the pocket, or each end of the two or more segregated pockets.

In some embodiments, the apparatus further comprises at least one securing mechanism configured to releasably capture and at least partially close the lengthwise edge or edges that comprise an edge of a pocket or pockets between the first inside surface and the second inside surface of the first two layers of the apparatus, or a lengthwise edge that forms a third layer or cover for the pocket or pockets.

In some embodiments, the apparatus further comprises at least one securing mechanism configured to releasably capture and at least partially close the first longitudinal end and/or the second longitudinal end of the at least one pocket.

In some embodiments, the at least one securing mechanism to releasably capture and at least partially close the lengthwise edge or edges, and/or ends of the pocket or pockets comprises: a lace, a flap; a Velcro™ connection; a compression snap; a zipper; a magnet; a buckle; a button; a clasp; a flexible material strap; and a hook.

In some embodiments of the apparatus, the first handle and second handle are permanently affixed.

In some embodiments of the apparatus, the first handle and second handle comprise collapsible hand grips, flexible bands; or a tubular grip with a flexible band of material extended therethrough and connected together at the ends thereof.

In some embodiments of the apparatus, the at least one pocket is configured to releasably capture and secure accessory articles.

In some embodiments, the exercise apparatus further comprises at least a releasably attachable third handle.

In some embodiments of the apparatus, the releasably attachable third handle comprises a flexible material strap.

In some embodiments of the apparatus, the releasably attachable third handle comprises an auxiliary fixation point and/or quick-release attachment coupling on a first end and a second end of the strap.

In some embodiments of the apparatus, the auxiliary fixation points and/or quick-release attachment couplings of the releasably attachable third handle are attachable to any of the fixation points on the exercise apparatus.

In some embodiments, the exercise apparatus further comprises at least one releasably attachable elastic band.

In some embodiments of the apparatus, the at least one releasably attachable elastic band comprises an auxiliary fixation point and/or quick-release attachment coupling on a first end and a second end of the attachable elastic band.

In any one of the embodiments of the apparatus, the coupling mechanism for releasably securing the ends of the connector strap of the layered strap-like apparatus comprises: a belt buckle; a cam buckle; a Velcro™ attachment; a Velcro™ hook and loop; airline seat buckle; a side release buckle; a double loop and strap of material; and a snap hook and ring.

In some embodiments, the belt buckle further comprises: a frame-style buckle; a plate-style buckle; a box-out buckle; and a box-frame buckle.

In some embodiments of the apparatus, the coupling mechanism is length-adjustable.

In any one of embodiments of the apparatus, the quick-release attachment coupling comprises: a carabiner; a snap hook; a bolt snap; a spring snap; a spring clip; a harness clip; a releasable captured hook and variations thereof.

In any one of embodiments of the apparatus, the quick-release attachment coupling is adapted to couple to any of the fixation points on the layered strap-like apparatus or belt-like strap, or an accessory device.

In any one of embodiments of the apparatus, the quick-release attachment coupling is adapted to couple to any stationary structure comprising a feature that can act as an anchoring point or a fixation point.

In any one of embodiments of the apparatus, the quick-release attachment coupling is adapted to couple to any other attachment feature, coupling mechanism, fixation point, coupling strap, or handle to facilitate wrapping the layered strap-like apparatus or strap-like belt around a stationary structure that can act as an anchoring point or a fixation point.

In any one of embodiments of the apparatus, the fixation point comprises: a circular ring; a reinforced material ring; a D-ring; a carabiner; a spring clip; a harness clip; a snap hook; and a releasable captured hook.

In any one of embodiments of the apparatus, the quick-release attachment couplings and fixation points comprise materials of sufficient strength to support a human and provide a factor of safety, such as alloy aluminum, steels and other metals known to those skilled in the art safety equipment, sky diving and mountain climbing, or any of the materials described below.

In any one of embodiments of the apparatus, the strap-like apparatus is adapted to be worn about the waist of the user's body. In any one of embodiments of the apparatus, the strap-like apparatus is adapted to be carried as a bandolier about the user's body. In any one of embodiments of the apparatus, the strap-like apparatus is adapted to be carried in a gym bag, back pack or similar equipment-carrying apparatus.

In some embodiments of the apparatus, the at least one releasably attachable elastic band comprises an elastic tension ranging from about: 1.0-5.0 lbs.; 2.0-10.0 lbs.; 5.0-15.0 lbs.; 10.0-20.0 lbs.; 15.0-30.0 lbs.; 20.0-40.0 lbs.; 25.0-50.0 lbs.; 30.0-60.0 lbs.; 35.0-70.0 lbs.; 40.0-80.0 lbs.; 45.0-90.0 lbs.; 50.0-100.0 lbs.; 60.0-120.0 lbs.; 75.0-150.0 lbs.; 100.0-200.0 lbs.; 150.0-250.0 lbs.; 200.0-400.0 lbs.; and from about 1.0-400 lbs.

In some embodiments of the apparatus, the at least one releasably attachable elastic band ranges in length from about: 0.5-2.0 feet, 1.0-2.0 feet, 1.5-2.0 feet; 1.5-3.0 feet; 1.5-4.0 feet; 1.5-5.0 feet; 1.5-6.0 feet; 1.5-7.0 feet; 1.5-8.0 feet; 1.5-9.0 feet; and from about 0.5-10.0 feet.

In some embodiments, the apparatus comprises at least one releasably attachable non-elastic band and/or at least one releasably attachable elastic band.

In some embodiments of the apparatus, the at least one releasably attachable non-elastic band or releasably attachable elastic band comprises a protective sleeve to prevent or at least reduce wear, abrasion, tearing and scoring of the non-elastic or elastic bands during use. In some embodiments, the sleeve prevents overstretching of the non-elastic or elastic bands during use. In some embodiments, the protective sleeve has an elastic quality to allow it to stretch with the underlying band. In some embodiments, the elastic protective sleeve prevents overstretching of the non-elastic or elastic bands during use.

In some embodiments of the apparatus, the elastic band comprises a non-elastic inner band to prevent or at least reduce overstretching and possible failure of the elastic bands during use.

In some embodiments of the apparatus, an accessory article comprises: an elastic band, a non-elastic band, a detachable flexible handle, a running parachute, a suspension cord, a suspension harness, a parachute cord, an additional coupling, an additional quick-release attachment coupling mechanism, a flexible water canteen; and a glove.

In some embodiments of the apparatus, a quick-release attachment coupling mechanism comprises: a circular ring; a D-ring; a carabiner; a spring clip; a harness clip; a snap hook; and a releasable captured hook.

In some embodiments of the apparatus, the strap-like apparatus comprises wear-resistant material comprising: nylon; moleskin; polyester; polypropylene; aramid polymer fabric; Kevlar®; technical fabric; SuperFabric®; Cordura®; Spectra Shield®; Dyneema®; Tegris™ polypropylene; Innegra™; HB51; Protech®; Gold Shield®; polyethylene naphthalate (PEN); Vectran®; high-modulus polyethylene; ABC-Matrix© Technora®, Vectran®; Ultra High Molecular Weight Polyethylene (UHMWPE); Twaron®; Zylon®; Carbon Fiber; Mylar®; Chlorosulfonated polyethylene (Hypalon, CSPE, CSM) and/or leather.

In some embodiments of the strap-like apparatus, the apparatus further comprises one or more of a plurality of safety features comprising: reflective tape; neon coloring; florescent coloring; a flashing light unit; a RFID tracking device; a GPS tracking device; and a geolocation device.

Provided herein is a method of using an exercise apparatus comprising: providing a strap-like apparatus adapted to be worn about the user's body, wherein the strap-like apparatus comprises at least a first layer and a second layer, wherein the first layer comprises a first inside surface and a first outside surface and the second layer comprises a second inside surface and a second outside surface; providing at least one pocket between the first layer and the second layer; attaching a connector strap comprising a first end and a second end and affixed to the outside surface or inside surface of the first layer, wherein the connector strap comprises a coupling mechanism for releasably securing the first end and second end of the connector strap to each other; affixing a first handle and a second handle to the connector strap or directly to an outside surface of the exercise apparatus, wherein each first handle and second handle is spaced approximately equidistant from the lengthwise center of the strap-like apparatus; affixing a first fixation point adjacent to a first end of the strap-like apparatus, extending outside of the pocket; and affixing a second fixation point adjacent to a second end of the strap-like apparatus, extending outside of the pocket; affixing a third fixation point to the to the connector strap at the approximate lengthwise center of the strap-like apparatus connector strap and making it accessible through an access point in the layers of the strap-like apparatus; wherein the strap-like apparatus is adapted for exercising various muscle groups of the body of a user when performing suspension exercises, resistance exercises, stretching exercises, aerobic exercises, or other combination exercises with said apparatus as a component of a total body workout.

In some embodiments of the method, the strap-like apparatus is removed from the user's body and wrapped about a stable vertical or horizontal structure such as a tree or pole, wherein a first end of a first elastic band and a first end of a second elastic band are affixed to any two of the fixation points of the strap-like apparatus, wherein the user performs resistance or stretching exercises with the elastic bands while holding the bands with the hands.

In some embodiments of the method, the resistance exercises comprise: pulling; pushing; spinal flexion; spinal extension; spinal rotation; shoulder internal rotation; shoulder external rotation; lateral flexion; shoulder abduction; shoulder adduction; shoulder flexion; and shoulder extension. In some embodiments of the method, the resistance exercises comprise: arm curls; and arm extensions.

In some embodiments of the method, the stretching exercises comprise: pulling; pushing; leg extension, hamstring extension, spinal flexion; spinal extension; spinal rotation; shoulder internal rotation; shoulder external rotation; lateral flexion; shoulder abduction; shoulder adduction; shoulder flexion; and shoulder extension.

In some embodiments of the method, the strap-like apparatus is removed from the user's body and wrapped about a stable vertical or horizontal structure such as a tree or pole, wherein a first end of a first elastic band is affixed to any one of the fixation points of the strap-like apparatus, a detachable flexible handle is wrapped around the user's ankle or foot and attached the second end of the first elastic band, wherein the user performs limb resistance exercises with the elastic bands with their legs.

In some embodiments of the method, the resistance exercises comprise: hip abduction; hip adduction; dorsiflexion; plantarflexion; knee extension; knee flexion; hip flexion; hip extension; eversion; inversion; and lateral resistance steps.

In some embodiments of the method, the strap-like apparatus is removed from the user's body and suspended about a hanging structure capable of supporting the user, wherein the user performs pull-ups or chin-ups utilizing any the handles affixed to the strap-like apparatus.

In some embodiments of the method, the strap-like apparatus is removed from the user's body and suspended about a hanging structure capable of supporting the user, wherein the first end of a first elastic band and the first end of a second elastic band are each affixed to any of the fixation points; a first end of a flexible strap handle is connected to the second end of the first elastic band and a second end of the detachable flexible handle is connected to the second end of the second strap-like apparatus, creating a suspended strap step; wherein the user can step or kneel on the suspended strap step while grasping any of the affixed handles of the strap-like apparatus and performing assisted suspension exercises, such as assisted pull-ups or chin-ups.

In some embodiments of the method, the first end of at least a first elastic band is affixed to any of the fixation points of the strap-like apparatus, wherein the user performs limb resistance exercises with an elastic band while holding the band in a hand with the strap-like apparatus secured about the user's waist.

In some embodiments of the method, the first end of a first elastic band is affixed to any of the fixation points of the strap-like apparatus, wherein the user performs limb resistance exercises with an elastic band in a hand while holding the band and standing on the strap-like apparatus with the user's feet or kneeling on the strap-like apparatus.

In some embodiments of the method, the resistance exercises comprise: elbow flexion; elbow extension; shoulder abduction; shoulder internal rotation, shoulder external rotation; shoulder extension; shoulder flexion; lateral flexion; and tension squatting exercises.

In some embodiments of the method, the first end of a first elastic band is affixed to the fixation point located on the outside surface of the strap-like apparatus, the second end of the first elastic band comprising a quick-release attachment coupling is affixed to an anchoring point of a stationary structure, wherein the user performs resistance running exercises with the elastic band providing a resistance force while the strap-like apparatus is secured about the user's waist.

In some embodiments of the method, the first end of a first elastic band is affixed to the fixation point located on the outside surface of the strap-like apparatus, (the center of connecting strap) the second end of the first elastic band comprising a quick-release attachment coupling with a detachable handle is held by another person, wherein the user performs resistance running exercises with the elastic band and other person providing a resistance force while the strap-like apparatus is secured about the user's waist.

In some embodiments of the method, the first end of a first elastic band is affixed to the fixation point located on the outside surface of the strap-like apparatus, (the center of connecting strap) the second end of the first elastic band comprising an attached handle is held by another person, wherein the user performs resistance running exercises with the elastic band while the strap-like apparatus is secured about the user's waist.

In some embodiments of the method, the first end of a first elastic band is affixed to the fixation point located on the outside surface of the strap-like apparatus, (center of connecting strap) the second end of the first elastic band comprising a quick-release attachment coupling is affixed to an anchoring point of a stationary structure, wherein the user performs resistance running exercises with the elastic band while the strap-like apparatus is secured about the user's body as a bandolier or waist.

In some embodiments of the method, the first end of a first elastic band is affixed to the fixation point located in the lengthwise center of the strap-like apparatus, the second end of the first elastic band comprising an optional handle is held by another person, wherein the user performs resistance running exercises with the elastic band while the strap-like apparatus is secured about the user's body as a bandolier or waist.

In some embodiments of the method, at least a second band is affixed to the fixation point located in outer surface of the first layer of the strap-like apparatus for additional resistance.

In some embodiments of the method, the first end of a first elastic band and the first end of a second elastic band are each affixed to any of the fixation points; the second end of the first elastic band and the second end of the second elastic band each comprising a quick-release attachment coupling are each affixed to an anchoring point of a stationary structure above the user capable of supporting the user's weight, wherein the user can step on the suspended strap-like apparatus, while grasping the stationary structure above the user's head and performing assisted suspension exercises.

Provided herein is a kit for an exercise apparatus comprising a strap-like apparatus adapted to be worn about the user's body, wherein the strap-like apparatus comprises at least a first layer and a second layer, wherein the first layer comprises a first inside surface and a first outside surface and the second layer comprises a second inside surface and a second outside surface; at least one pocket between the first layer and the second layer; a connector strap comprising a first end and a second end and affixed to the outside surface or inside surface of the first layer, wherein the connector strap comprises a coupling mechanism for releasably securing the first end and second end of the connector strap to each other; a first handle and a second handle affixable to the connector strap or directly to an outside surface of the exercise apparatus, wherein each first handle and second handle is spaced approximately equidistant from the lengthwise center of the strap-like apparatus; at least one fixation point affixed to the apparatus; and at least one releasably attachable elastic band.

In some embodiments of the kit, the strap-like apparatus comprises a third layer, wherein the third layer comprises a third inside surface and a third outside surface.

In some embodiments of the kit, the third layer is an extension of the first layer and folds over the second layer to enclose the at least one pocket between the first inside surface and the second inside surface.

In some embodiments of the kit, the layers are formed from a single piece of folded material.

In some embodiments of the kit, the layers are formed from two or more pieces of material and joined along their lengthwise edges.

In some embodiments of the kit, the at least one fixation point is located at the approximate lengthwise center of the connector strap and accessible through an access point in the layers of the strap-like apparatus.

In some embodiments, the kit further comprises a detachable flexible handle; a running parachute; a suspension cord; a suspension harness; a parachute cord; a coupling mechanism; a flexible water canteen; a glove; a drinking tube; a flow valve and one or more of a plurality of safety features.

In some embodiments, the kit further comprises a second fixation point affixed adjacent to a first end of the strap-like apparatus, extending outside of the pocket and a third fixation point affixed adjacent to a second end of the strap-like apparatus, extending outside of the pocket, wherein the second and third fixation points are affixed between the first and second layers and to the connector strap or are affixed directly to the connector strap.

INCORPORATION BY REFERENCE

All publications, patents, and patent applications mentioned in this specification are herein incorporated by reference to the same extent as if each individual publication, patent, or patent application was specifically and individually indicated to be incorporated by reference.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

Figure 1:
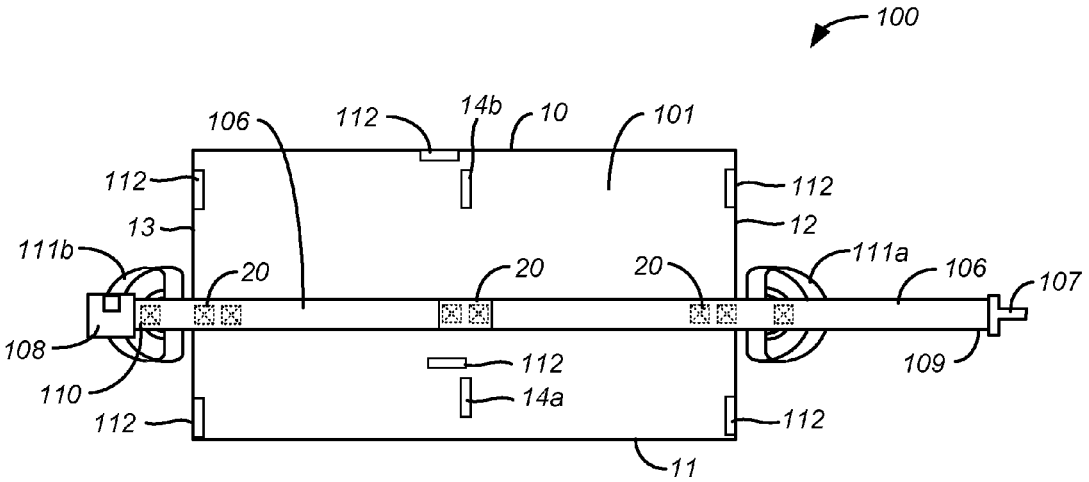
FIG. 1 is an illustrative plan view of an exemplary exercise strap-like apparatus in an unfolded state, illustrating the outer surface layer, a connector strap comprising a first end and a second end and affixed to the outside surface layer, two handles affixable to the connector strap, spaced approximately equidistant from the lengthwise center of the unfolded strap-like apparatus, fixation points (D-rings) positioned approximately adjacent to a first end and second end of the outside surface layer of the strap-like apparatus, each fixation point being further secured to the connector strap, and a coupling mechanism comprising a pair of securing mechanisms components, said individual components at each end of the connector strap for releasably securing the first end and second end of the connector strap to each other.
Figure 2:
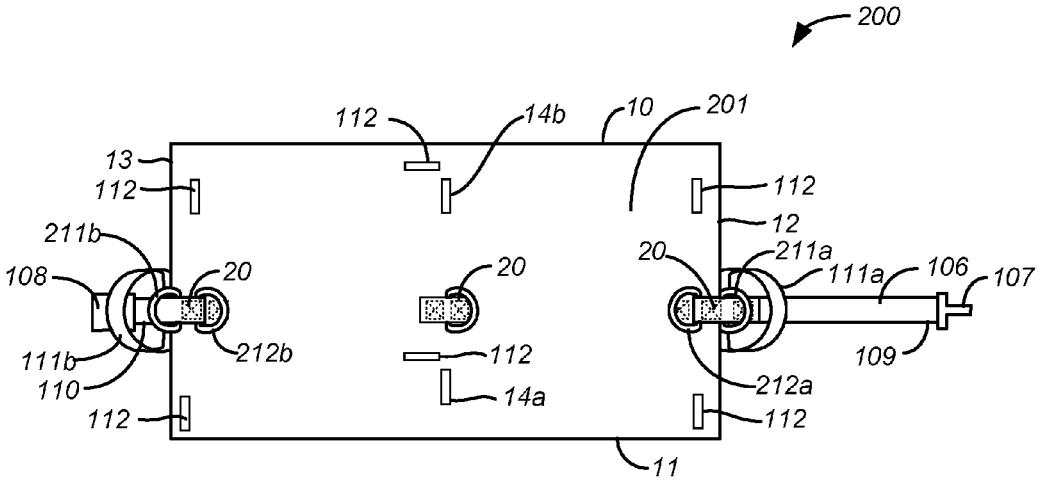
FIG. 2 is an illustrative plan view of an exemplary exercise strap-like apparatus in an unfolded state, illustrating the inner surface layer of the strap-like apparatus, the ends of the a connector strap, each comprising ½ of a securing mechanism for releasably securing the first end and second end of the connector strap to each other, multiple fixation points (D-rings) positioned and secured approximately adjacent to a first end (2 each) and second end (2 each) of the outside surface layer of the strap-like apparatus and an additional fixation point (D-rings) positioned in the approximate center of the inside surface of the strap-like apparatus, each fixation point being further secured to the connector strap.

These representative views are not intended as limiting representations. One skilled in the art would recognize that this apparatus could be fabricated in a wide variety of combinations and configurations as illustrated herein, or from any number of recognized materials, or be configured similarly to any of the described shapes or configurations. In addition, the methods described herein are not intended to be limiting in any way. One skilled in the art would recognize that this apparatus could be utilized in many ways and could have many uses beyond those described herein.

DETAILED DESCRIPTION OF THE INVENTION

The present invention provides a novel and a versatile exercise apparatus for exercising multiple muscle groups of the user's body that comprises a layered strap-like apparatus, an attached connector strap and handles adapted to be worn about the waist or carried across the chest of the user's body as a bandolier. The portable apparatus is light weight, easy to use, easily transportable and provides the athletic enthusiast with accessories that can add variety to their gym routine and allow them to have a fitness experience anywhere.

As used herein, and unless otherwise specified, the terms "strap-like belt", "layered strap", "layered strap-like belt" or "strap apparatus" are understood to have a synonymous interpretation meaning an apparatus comprising at least two layers with a pocket therebetween when assembled, with a connector strap and coupling mechanism attached thereto, adaptable to be worn about the body of a person, as an exercise device, as would be commonly understood by one skilled in the art.

The strap-like apparatus comprises at least one pocket between the layers of the strap-like apparatus for securing and carrying exercise accessories, such as releasable handles, ropes, bands or elastic bands attachable to multiple fixation points located about the strap-like apparatus. The apparatus and described methods of use provide the user with balanced loading options to develop even muscle tone or muscle stretching options, while providing the user with the flexibility to exercise, indoors, outdoors or anywhere.

Alternatively, one skilled in the art would understand that the strap-like apparatus described herein may comprise a single "base" layer, with one or more pockets comprising at least one auxiliary layer formed on one or both sides of the base layer of the strap-like apparatus.

The apparatus can be worn or carried anywhere by the user and can provide an individual with portable exercise equipment to perform balanced resistance, stretching and tension training utilizing, among other things, elastic and non-elastic bands, and detachable and affixed flexible handles used in various exercise protocols and therapeutic applications.

Provided herein is an exercise apparatus comprising a strap-like apparatus or strap-like belt, as illustrated in FIGS. 1-5, the exercise apparatus 100, 200, 300, 400, 500, 600 adapted to be worn about the user's body, wherein the apparatus comprises at least a first layer 101 and a second layer 201, wherein, when assembled, the first layer 101 comprises a first inside surface 303 and a first outside surface 61, and the second layer 201 comprises a second inside surface 304 and a second outside surface 61; a pocket 301 or pockets, having the inside surfaces 303, 304 between the first layer 101 and the second layer 201, which can be continuous or segregated into two or more compartment-like pockets; a connector strap 106 comprising a first end 109 and a second end 110 and affixed to the outside surface 61 or inside surface 51 of the first layer 101, wherein the connector strap 106 comprises a coupling mechanism 210 comprising components 107, 108 for releasably securing the first end 109 and second end 110 of the connector strap to each other; a first handle 111*a* and a second handle 111*b* permanently or temporarily affixable to the connector strap 106 or directly to the outside of the apparatus, wherein each handle 111 is spaced approximately equidistant from the lengthwise center of the layered strap-like apparatus; a first fixation point 211*a* affixed adjacent to the first end 12 of the strap-like apparatus, extending outside of the pocket 301; and a second fixation point 211*b* affixed adjacent to the second end 13 of the strap-like apparatus, extending outside of the pocket 301; wherein the first and second fixation points 211*a*, 211*b* are affixed or secured between the first and second layers and to the connector strap or are affixed directly to the connector strap at an assembly point 20.

Figure 4:
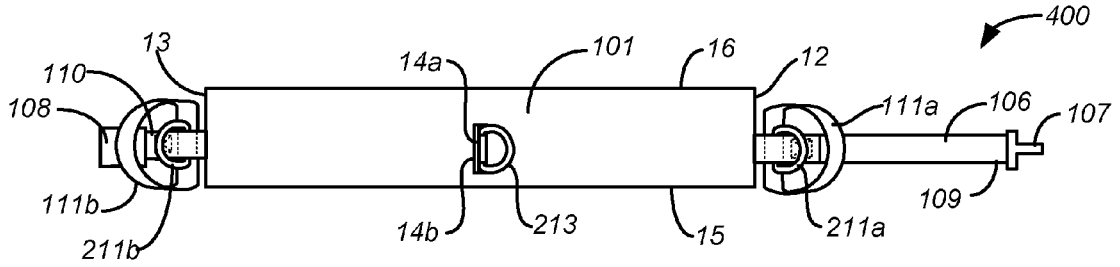
FIG. 4 is an illustrative front plan view of a fully assembled exemplary multi-layered exercise strap-like apparatus of FIG. 3, further illustrating the formation of an inner pocket with a (third layer) outer covering, and further illustrating the exposed central fixation point (D-ring) protruding through the access slot in the outer covering (third) layer.
Figure 5:
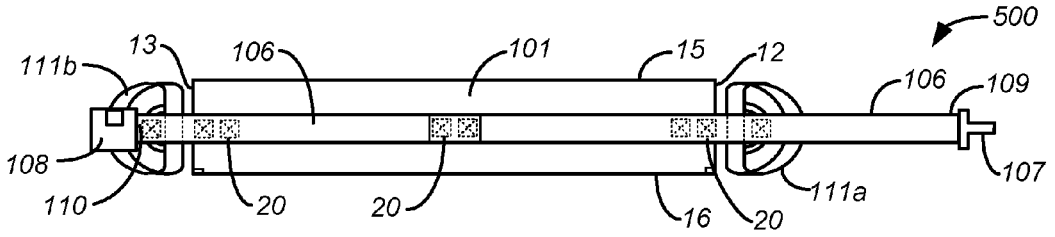
FIG. 5 is an illustrative back plan view of a fully assembled exemplary multi-layered exercise strap-like apparatus of FIG. 4, further illustrating the full connector strap and reinforced (sewn) connection points for the various fixation points (D-rings) and handles.

In some embodiments, the device comprises a third layer 401, wherein the third layer comprises a third inside surface and a third outside surface. In some embodiments, the third layer is an extension of the first layer and folds over the second layer 201 wherein edge 10 is folded over to meet edge 15 to enclose the at least one pocket 301 between the first inside surface and the second inside surface, as illustrated in FIG. 4.

Figure 3:
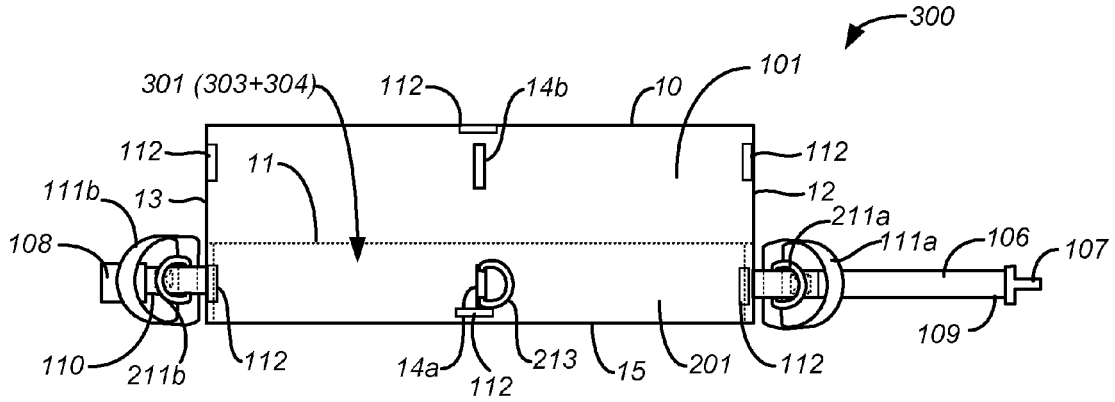
FIG. 3 is an illustrative plan view of an exemplary exercise strap-like apparatus in a partially folded state, creating a two-layer assembly, illustrating the formation of an inner pocket with an outer covering, unfolded third layer above, and further illustrating the exposed central fixation point (D-ring) protruding through the access slot in the second layer and two outermost fixation points (D-rings), one each protruding from each end of the formed pocket in the strap-like apparatus. Two additional fixation points (D-rings), not shown, are hidden inside the formed pocket near the ends of the strap-like apparatus.

In one preferred embodiment of the apparatus, the at least one pocket is at least partially closable along a lengthwise edge 11. Multiple methods are described herein for achieving this. In one preferred embodiment as illustrated in FIG. 3 the apparatus includes at least one flap comprising surface 51 and further comprising at least one closing mechanism 112 which folds over the pocket 301 having edge 11 and is affixable to a mating closing mechanism 112 located about other surface of the pocket 301 or within the pocket. In one ideal example the closing mechanism 112 comprises magnets attached to the flap and within the pocket.

In some embodiments, the layers are formed from a single piece of folded material, folded along the lengthwise edges 15, 16. In some embodiments, the layers are formed from two or more pieces of material and joined along their lengthwise edges 15, 16.

Figure 6A:
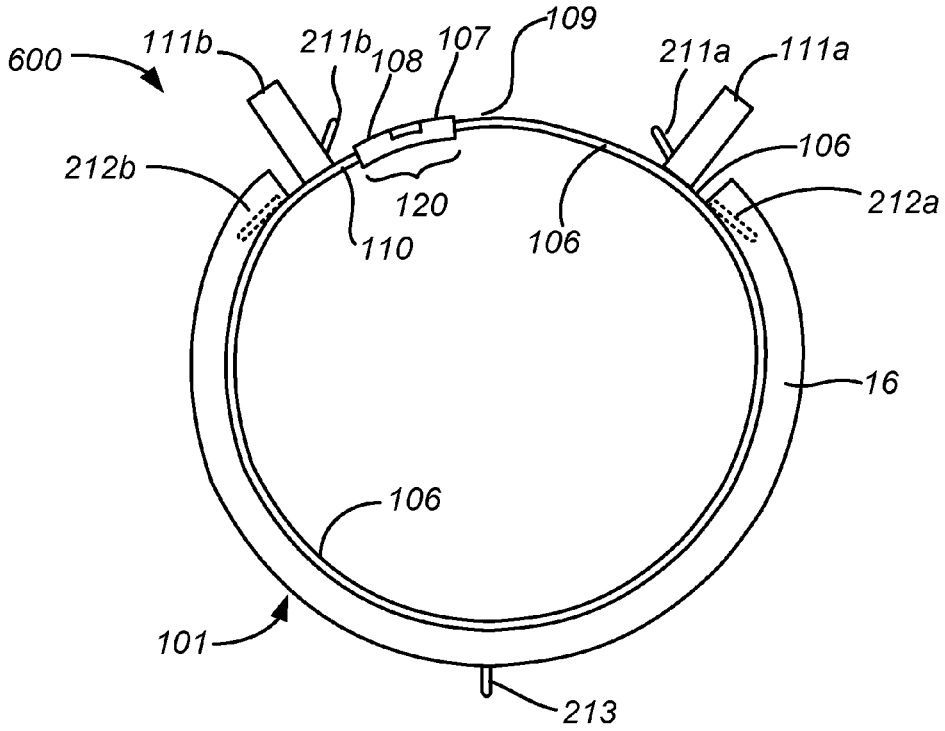
FIG. 6A is a top view of one of an exemplary assembled exercise apparatus illustrating a closed coupling mechanism and closed or covered inner pocket.
Figure 6B:
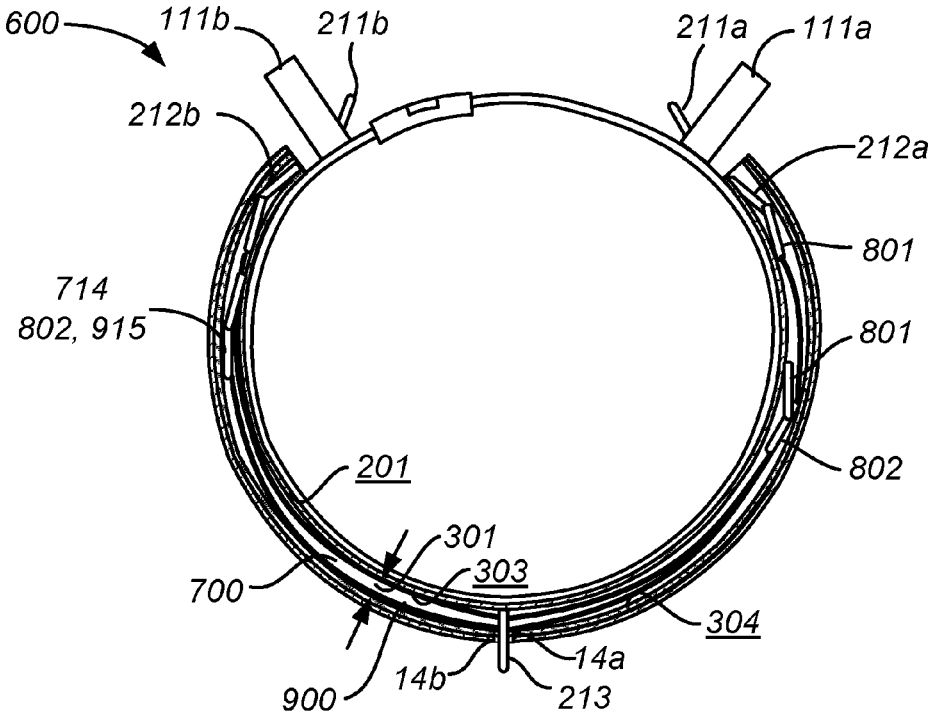
FIG. 6B is a top view of one of an exemplary assembled exercise apparatus illustrating a closed coupling mechanism and open or uncovered inner pocket, and further illustrating the internal placement of auxiliary items contained within the inner pocket, which can comprise for example; a flexible, releasable handle, elastic bands, additional attachment couplings such as a carabiner, gloves, etc.
Figure 6C:
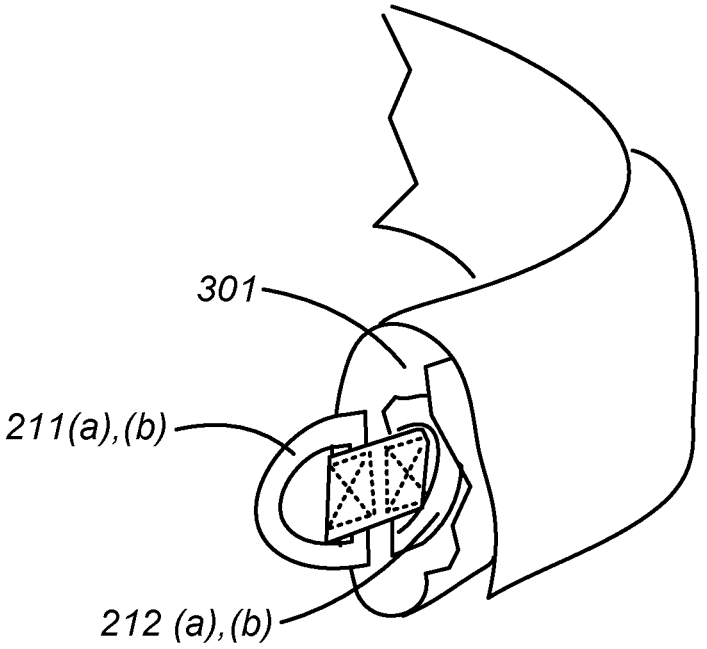
FIG. 6C is a representative partial end view of the exemplary assembled exercise apparatus of FIG. 6B illustrating one possible configuration for the attachment of fixation rings (211, 212) to the apparatus at or about the end of the pocket. The ends of the pocket may be open or closed.
Figure 6D:
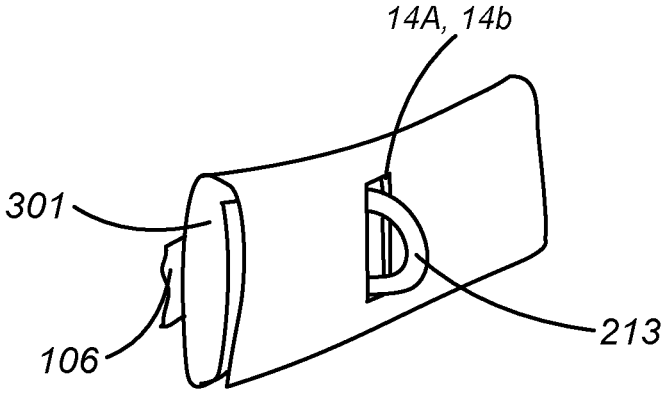
FIG. 6D is a representative view of the exemplary assembled exercise apparatus of FIG. 6B illustrating a representative attachment ring (213) protruding through the slots (14*a*, 14*b*) in the layers of the pocket.

In some embodiments, the exercise apparatus comprises a third fixation point 213 affixed to the connector strap 106 and through the approximate lengthwise center of the strap-like apparatus 100, 200, 300, 400, 500, 600 and accessible through at least one access point 14*a*, 14*b* in the layers of the strap-like apparatus as illustrated in FIG. 6D.

In some embodiments of the exercise apparatus, the at least one pocket 301 is at least partially closable along the lengthwise edge 11.

In some embodiments of the exercise apparatus, the at least one pocket is at least partially closable at the first longitudinal end 12 and/or the second longitudinal end 12.

In some embodiments, the apparatus further comprises at least one securing mechanism 112 configured to releasably capture and at least partially close the first longitudinal end 12 and/or the second longitudinal end 13 of the at least one pocket 301.

In some embodiments, the at least one securing mechanism 112 to releasably capture and at least partially close the lengthwise edge or edges, and/or ends of the pocket or pockets comprises: a lace, a flap; a Velcro™ connection; a compression snap; a zipper; a magnet; a buckle; a button; a clasp; a flexible material strap; and a hook.

In some embodiments of the exercise apparatus, the first longitudinal end 12 and/or the second longitudinal end 12 of the at least one pocket are at least partially closed with a permanent fixation means. In some embodiments, the permanent fixation means comprise thread; rivets; heat bonding materials; and glues or epoxies.

In some embodiments, the exercise apparatus comprises a fourth fixation point 212*a* affixed adjacent to the first end 12 of the strap-like apparatus and a fifth fixation point 212*b* affixed adjacent to the second end 13 of the strap-like apparatus, near the first and second fixation points 211*a*, 211*b*, wherein the fourth and fifth fixation points 212*a*, 212*b* are affixed between the first and second layers 101, 102, within the at least one pocket 301, and to the connector strap 106 at an assembly point 20 and are accessible from the inside of the at least one pocket, as more clearly illustrated in FIG. 6C. The fourth and fifth points 212*a*, 212*b* are ideally intended to provide secure locations to detachable secure attachment features intended for use with the exercise apparatus within pocket 301.

In some embodiments of the apparatus, the first handle 111*a* and second handle 111*b* are permanently affixed to the connector strap 106. In some embodiments of the apparatus, the first handle 111*a* and second handle 111*b* are permanently affixed to a secure layer 101 or layers 101, 201, 401 of the apparatus. 1*n* some embodiments of the apparatus, the first handle 111*a* and second handle 111*b* are permanently affixed to a layer or layers and the connector strap of the apparatus.

In some embodiments of the apparatus, the first handle 111*a* and second handle 111*b* comprise collapsible hand grips 702, flexible bands; or a tubular grip with a flexible band of material extended therethrough and connected together at the ends thereof (not shown).

In some embodiments of the apparatus 600, the at least one pocket 301 is configured to releasably capture and secure accessory articles, as illustrated in FIG. 6B. As further illustrated in FIGS. 6A and 6B, the at least one pocket 301 can be connected at the ends of the connector strap with an assembled coupling mechanism 120, comprising coupling components 107, 108, so that the apparatus can easily worn about a user's body. Further still the pocket 301 can be covered by a flap or third layer 401 to hide or secure various accessories contained therein.

In some embodiments, the exercise apparatus further comprises at least a releasably attachable third handle.

Figure 7A:
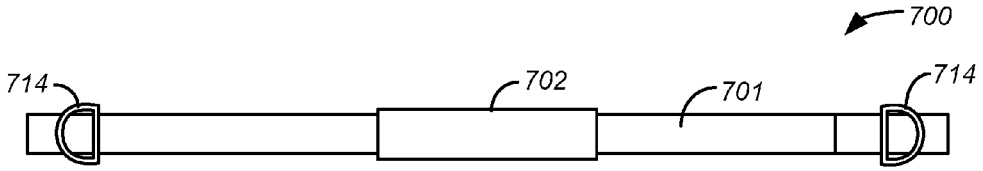
FIGS. 7A-7C are illustrative views of an exemplary detachable flexible handle strap in various states of assembly and further comprising end fixation points and a quick-release attachment coupling, such as a carabiner.
Figure 7B:
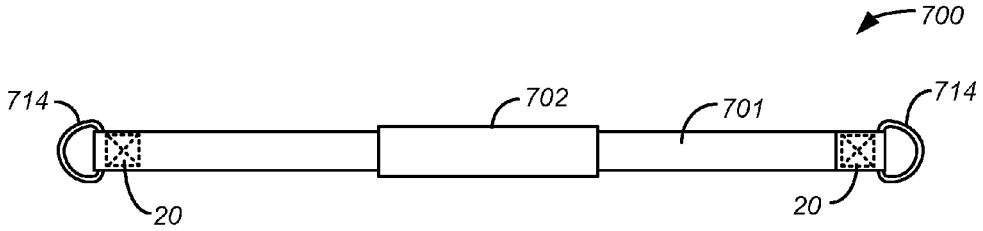
Figure 7C:
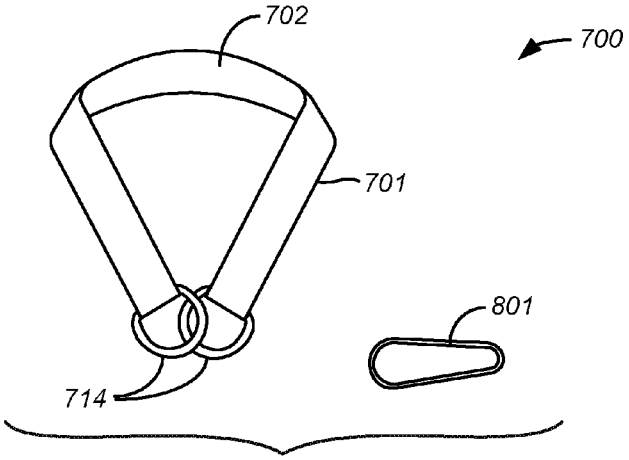

In some embodiments of the apparatus, the releasably attachable third handle comprises a flexible, wear resistant material strap 700 as illustrated in FIGS. 7A-7C.

In some embodiments of the apparatus, the releasably attachable third handle 700 comprises a strap material 701, a grip 702 (as previously described), an auxiliary fixation point 714 and/or quick-release attachment coupling 801 on a first end and a second end of the strap.

In some embodiments of the apparatus, the auxiliary fixation points 714 and/or quick-release attachment couplings 801 of the releasably attachable third handle 700 are attachable to any of the fixation points 211, 212, 213 on the exercise apparatus.

As further illustrated in FIGS. 7A-7C, the releasably attachable third handle may be assembled from a variety of materials and components, wherein the auxiliary fixation points 714 and/or quick-release attachment couplings 801 can be formed integral to the strap, (such as in a molding process), or secured to the strap at an assembly point 20.

In some embodiments of the apparatus, the third handle is attachable to any of the fixation points 211, 212, 213 on the apparatus or to any of the other accessory articles.

Figure 8:
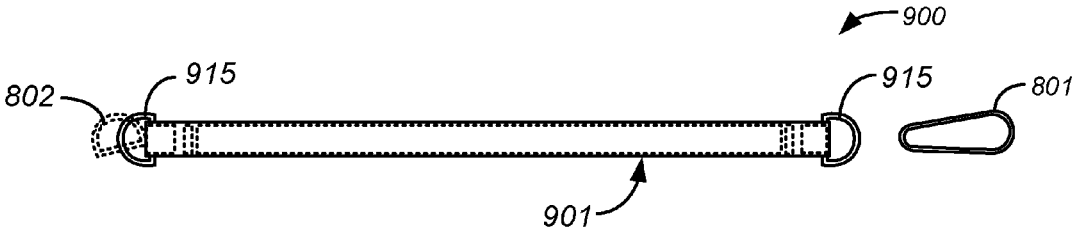
FIG. 8 is an illustrative view of an exemplary elastic band and further comprising end fixation points and a quick-release attachment coupling, such as a carabiner.

As illustrated in FIG. 8, some embodiments of the exercise apparatus further comprises at least one releasably attachable elastic band 900.

In some embodiments of the apparatus, the at least one releasably attachable elastic band 900 comprising an elastic band material 901 of variable length and tension, and further comprising an auxiliary fixation point 915 and/or quick-release attachment coupling 801, 802 on a first end and a second end of the attachable elastic band.

In any one of the elastic band embodiments, the auxiliary fixation points 915 and/or quick-release attachment couplings 801, 802 can be formed integral to the elastic band, (such as in a molding process), or secured to the strap at an assembly point 20.

In some embodiments of the apparatus, the elastic band is attachable to any of the fixation points 211, 212, 213 on the apparatus or to any of the other accessory articles.

In any one of the embodiments of the layered strap-like apparatus, the coupling mechanism 120 (107,108) for releasably securing the ends of the connector strap 106 comprises: a belt buckle; a cam buckle; a Velcro™ attachment; a Velcro™ hook and loop; airline seat buckle; a side release buckle; a double loop and strap of material; and a snap hook and ring.

In some embodiments, the belt buckle further comprises: a frame-style buckle; a plate-style buckle; a box-out buckle; and a box-frame buckle.

In some embodiments of the apparatus, the coupling mechanism is length-adjustable, providing the user with the ability to adjust the length of the connector strap to fit his or her torso appropriately.

In any one of embodiments of the apparatus, the quick-release attachment coupling 801, 802 comprises: a carabiner; a snap hook; a bolt snap; a spring snap; a spring clip; a harness clip; a releasable captured hook and variations thereof, wherein the quick-release attachment coupling is adapted to couple an accessory article to a fixation point on said exercise apparatus.

In any one of embodiments of the apparatus, the quick-release attachment coupling 801, 802 is adapted to couple to any of the fixation points 211, 212, 213 on the strap-like apparatus or an accessory device.

In any one of embodiments of the apparatus, the quick-release attachment coupling 801, 802 is adapted to couple to any stationary structure comprising a feature that can act as an anchoring point for the elastic band 900.

In any one of embodiments of the exercise apparatus, the fixation point 211, 212, 213 comprises: a circular ring; a reinforced material ring; a D-ring; a carabiner; a spring clip; a harness clip; a snap hook; and a releasable captured hook.

In any one of embodiments of the apparatus, the quick-release attachment couplings 801, 802 and fixation points 211, 212, 213 comprise materials of sufficient strength to support a human and provide a factor of safety, such as alloy aluminum, steels and other metals known to those skilled in the art safety equipment, sky diving and mountain climbing, or any of the materials described below.

In any one of embodiments of the apparatus, the belt/strap-like exercise apparatus 300, 400, 500, 600 is adapted to be worn about the waist of the user's body. In any one of embodiments of the apparatus, the belt/strap-like exercise apparatus 300, 400, 500, 600, is adapted to be carried as a bandolier about the user's body. In any one of embodiments of the apparatus 100, 200, 300, 400, 500, 600, the strap-like apparatus is adapted to be carried in a gym bag, back pack or similar equipment-carrying apparatus.

In some embodiments of the apparatus, the at least one releasably attachable elastic band 900 comprises an elastic tension ranging from about: 1.0-5.0 lbs.; 2.0-10.0 lbs.; 5.0-15.0 lbs.; 10.0-20.0 lbs.; 15.0-30.0 lbs.; 20.0-40.0 lbs.; 25.0-50.0 lbs.; 30.0-60.0 lbs.; 35.0-70.0 lbs.; 40.0-80.0 lbs.; 45.0-90.0 lbs.; 50.0-100.0 lbs.; 60.0-120.0 lbs.; 75.0-150.0 lbs.; 100.0-200.0 lbs.; 150.0-250.0 lbs.; 200.0-400.0 lbs.; and from about 1.0-400 lbs.

In some embodiments of the apparatus, the at least one releasably attachable elastic band 900 ranges in length from about: 0.5-2.0 feet, 1.0-2.0 feet, 1.5-2.0 feet; 1.5-3.0 feet; 1.5-4.0 feet; 1.5-5.0 feet; 1.5-6.0 feet; 1.5-7.0 feet; 1.5-8.0 feet; 1.5-9.0 feet; and from about 0.5-10.0 feet.

As used herein, and unless otherwise specified, the term "about" or "approximately" means an acceptable error for a particular value as determined by one of ordinary skill in the art, which depends in part on how the value is measured or determined. In certain embodiments, the term "about" or "approximately" means within 1, 2, 3, or 4 standard deviations. In certain embodiments, term "about" or "approximately" means within 30%, 25%, 20%, 15%, 10%, 9%, 8%, 7%, 6%, 5%, 4%, 3%, 2%, 1%, 0.5%, 0.1%, or 0.05% of a given value or range. In certain embodiments, the term "about" or "approximately" means within 40.0 inches, 30.0 inches, 20.0 inches, 10.0 inches, 5.0 inches, 1.0 inches, 0.9 inches, 0.8 inches, 0.7 inches, 0.6 inches, 0.5 inches, 0.4 inches, 0.3 inches, 0.2 inches or 0.1 inches of a given value or range. In certain embodiments, the term "about" or "approximately" means within 40.0 mm, 30.0 mm, 20.0 mm, 10.0 mm, 5.0 mm, 1.0 mm, 0.9 mm, 0.8 mm, 0.7 mm, 0.6 mm, 0.5 mm, 0.4 mm, 0.3 mm, 0.2 mm or 0.1 mm of a given value or range. In certain embodiments, the term "about" or "approximately" means within 40.0 lbs., 30.0 lbs., 20.0 lbs., 10.0 lbs., 5.0 lbs., 1.0 lbs., 0.9 lbs., 0.8 lbs., 0.7 lbs., 0.6 lbs., 0.5 lbs., 0.4 lbs., 0.3 lbs., 0.2 lbs. or 0.1 lbs. of a given value or range. In certain embodiments, the term "about" or "approximately" means within 20.0 kg., 10.0 kg., 5.0 kg., 1.0 kg., 0.9 kg., 0.8 kg., 0.7 kg., 0.6 kg., 0.5 kg., 0.4 kg., 0.3 kg., 0.2 kg., 0.1 kg., or 0.05 kg. of a given value or range.

As used herein, and unless otherwise specified, the term "about" when used with respect to a weight or tension load means variations up to 5%, up to 10%, up to 15%, up to 20%, up to 25%, and up to 30%. For example: If the amount of weight or tension load is "10.0 lbs.," this may include variations of up to 5%, i.e. 9.5-10.5 lbs., variations of up to 10%, i.e. 9.0-11.0 lbs., variations of up to 15%, i.e. 8.5-11.5 lbs., variations of up to 20%, i.e. 8.0-12.0 lbs., variations of up to 25%, i.e. 7.5-12.5 lbs., or variations of up to 30%, i.e. 7.0-13.0 lbs.

As used herein, and unless otherwise specified, the term "about" when used with respect to a length means variations up to 5%, up to 10%, up to 15%, up to 20%, up to 25%, and up to 30%. For example: If the amount of the length is "10.0 ft.," this may include variations of up to 5%, i.e. 9.5-10.5 ft., variations of up to 10%, i.e. 9.0-11.0 ft., variations of up to 15%, i.e. 8.5-11.5 ft., variations of up to 20%, i.e. 8.0-12.0 ft., variations of up to 25%, i.e. 7.5-12.5 ft., or variations of up to 30%, i.e. 7.0-13.0 ft.

In some embodiments, the apparatus comprises at least one releasably attachable non-elastic band and/or at least one releasably attachable elastic band.

In some embodiments of the apparatus the at least one releasably attachable elastic band 900 comprises a protective sleeve (not shown) to prevent or at least reduce wear, abrasion, tearing and scoring of the elastic bands from during use. In some embodiments the protective sleeve prevents overstretching of the non-elastic or elastic bands during use. In some embodiments, the protective sleeve has an elastic quality to allow it to stretch with the underlying band. In some embodiments the elastic protective sleeve prevents overstretching of the non-elastic or elastic bands during use.

In some embodiments of the apparatus, the elastic band comprises a non-elastic inner band to prevent or at least reduce overstretching and possible failure of the elastic bands during use.

In some embodiments of the apparatus, an accessory article comprises: an elastic band 900; a non-elastic band (not shown); a detachable flexible handle 700; a running parachute (not shown); a suspension cord (not shown); a suspension harness (not shown); parachute cord (not shown); a quick-release coupling mechanism 801, 802; a flexible water canteen (not shown); and a glove (not shown).

In some embodiments of the apparatus, the strap-like apparatus or components thereof comprise wear-resistant material comprising: nylon; moleskin; polyester; polypropylene; aramid polymer fabric; Kevlar®; technical fabric; SuperFabric®; Cordura®; Spectra Shield®; Dyneema®; Tegris™ polypropylene; Innegra™; HB51; Protech®; Gold Shield®; polyethylene naphthalate (PEN); Vectran®; high-modulus polyethylene; ABC-Matrix©; Technora®; Vectran®; Ultra High Molecular Weight Polyethylene (UHMWPE); Twaron®; Zylon®; Carbon Fiber; Mylar®; and or leather.

In some embodiments of the apparatus, the strap-like apparatus further comprises one or more of a plurality of safety features comprising: reflective tape; neon coloring; florescent coloring; a flashing light unit (not shown); RFID tracking device (not shown); GPS tracking device (not shown); and a geolocation device (not shown).

In some embodiments of the apparatus, an additional (fourth) layer is contemplated, creating a second pocket or pockets, wherein a user can store certain accessory items that may be required less frequently, or don't require removal during normal use, such as one or more thin flexible water bottles or water sacks comprising extendable water tubes, suction straws and flow valves that a user can access as needed during an extended exercise routine. Placement of the water sacks could be in the second pocket, on either side of center fixation point, in order to avoid placing undue stress on the water sacks during routine suspension exercises where the apparatus is suspended (about the approximate center of the belt) from a hanging structure, or wrapped around a support structure such as a pole, when performing horizontal or vertical resistance exercises.

Provided herein is a method of using an exercise apparatus comprising: providing a strap-like apparatus adapted to be worn about the user's body, wherein the strap-like apparatus comprises at least a first layer and a second layer, wherein the first layer comprises a first inside surface and a first outside surface and the second layer comprises a second inside surface and a second outside surface; providing at least one pocket between the first layer and the second layer; attaching a connector strap comprising a first end and a second end and affixed to the outside surface or inside surface of the first layer, wherein the connector strap comprises a coupling mechanism for releasably securing the first end and second end of the connector strap to each other; affixing a first handle and a second handle to the connector strap or directly to an outside surface of the exercise apparatus, wherein each first handle and second handle is spaced approximately equidistant from the lengthwise center of the strap-like apparatus; affixing a first fixation point adjacent to a first end of the strap-like apparatus, extending outside of the pocket; and affixing a second fixation point adjacent to a second end of the strap-like apparatus, extending outside of the pocket; affixing a third fixation point to the to the connector strap at the approximate lengthwise center of the strap-like apparatus connector strap and making it accessible through an access point in the layers of the strap-like apparatus; wherein the strap-like apparatus is adapted for exercising various muscle groups of the body of a user when performing suspension exercises, resistance exercises, stretching exercises, aerobic exercises, or other combination exercises with said apparatus as a component of a total body workout.

In some embodiments of the method, the strap-like apparatus is removed from the user's body and wrapped about a stable vertical or horizontal structure such as a tree or pole, wherein a first end of a first elastic band and a first end of a second elastic band are affixed to any two of the fixation points of the strap-like apparatus, wherein the user performs resistance or stretching exercises with the elastic bands while holding the bands with the hands.

In some embodiments of the method, the resistance exercises comprise: pulling; pushing; spinal flexion; spinal extension; spinal rotation; shoulder internal rotation; shoulder external rotation; lateral flexion; shoulder abduction; shoulder adduction; shoulder flexion; and shoulder extension. In some embodiments of the method, the resistance exercises comprise: arm curls; and arm extensions.

In some embodiments of the method, the stretching exercises comprise: pulling; pushing; leg extension, hamstring extension, spinal flexion; spinal extension; spinal rotation; shoulder internal rotation; shoulder external rotation; lateral flexion; shoulder abduction; shoulder adduction; shoulder flexion; and shoulder extension.

In some embodiments of the method, the strap-like apparatus is removed from the user's body and wrapped about a stable vertical or horizontal structure such as a tree or pole, wherein a first end of a first elastic band is affixed to any one of the fixation points of the strap-like apparatus, a detachable flexible handle is wrapped around the user's ankle or foot and attached the second end of the first elastic band, wherein the user performs limb resistance exercises with the elastic bands with their legs.

In some embodiments of the method, the resistance exercises comprise: hip abduction; hip adduction; dorsiflexion; plantarflexion; knee extension; knee flexion; hip flexion; hip extension; eversion; inversion; and lateral resistance steps.

In some embodiments of the method, the strap-like apparatus is removed from the user's body and suspended about a hanging structure capable of supporting the user, wherein the user performs pull-ups or chin-ups utilizing any the handles affixed to the strap-like apparatus.

In some embodiments of the method, the strap-like apparatus is removed from the user's body and suspended about a hanging structure capable of supporting the user, wherein the first end of a first elastic band and the first end of a second elastic band are each affixed to any of the fixation points; a first end of a flexible strap handle is connected to the second end of the first elastic band and a second end of the detachable flexible handle is connected to the second end of the second strap-like apparatus, creating a suspended strap step; wherein the user can step or kneel on the suspended strap step while grasping any of the affixed handles of the strap-like apparatus and performing assisted suspension exercises, such as assisted pull-ups or chin-ups.

Figure 9:
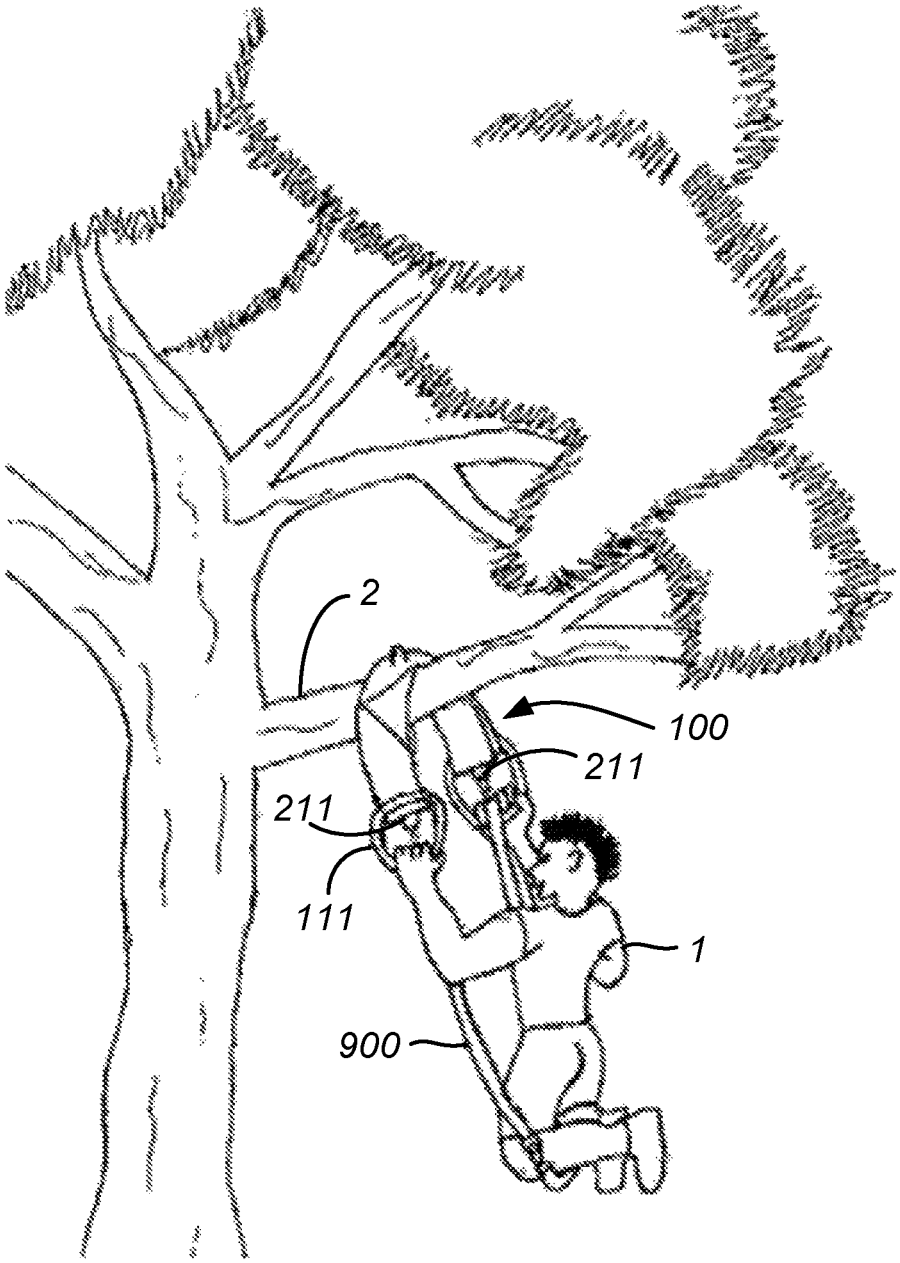
FIG. 9 is an illustrative view of a user performing an exercise routine with the apparatus.

As illustrated in FIG. 9, a user can suspend the apparatus 100 over a structure capable of supporting a weight in excess of the user 1, such as a large tree limb 2, and performing various strength building exercises, such as pull-ups or assisted pull-ups. As illustrated herein, a user 1 is performing assisted pull-ups by kneeling in a suspended elastic band 900, while grasping the apparatus handles 111, allowing the elastic bands 900 to partially support his/her weight during the exercise. Of course, it would be obvious to one skilled in the art that the user can perform the same exercise without the assistance of the elastic bands 900.

In some embodiments of the method, the first end of at least a first elastic band is affixed to any of the fixation points of the strap-like apparatus, wherein the user performs limb resistance exercises with an elastic band while holding the band in a hand with the strap-like apparatus secured about the user's waist.

In some embodiments of the method, the first end of a first elastic band is affixed to any of the fixation points of the strap-like apparatus, wherein the user performs limb resistance exercises with an elastic band in a hand while holding the band and standing on the strap-like apparatus with the user's feet or kneeling on the strap-like apparatus.

In some embodiments of the method, the resistance exercises comprise: elbow flexion; elbow extension; shoulder abduction; shoulder internal rotation, shoulder external rotation; shoulder extension; shoulder flexion; lateral flexion; and tension squatting exercises.

In some embodiments of the method, the first end of a first elastic band is affixed to the fixation point located on the outside surface of the strap-like apparatus, the second end of the first elastic band comprising a quick-release attachment coupling is affixed to an anchoring point of a stationary structure, wherein the user performs resistance running exercises with the elastic band providing a resistance force while the strap-like apparatus is secured about the user's waist.

In some embodiments of the method, the first end of a first elastic band is affixed to the fixation point located on the outside surface of the strap-like apparatus, (the center of connecting strap) the second end of the first elastic band comprising a quick-release attachment coupling with a detachable handle is held by another person, wherein the user performs resistance running exercises with the elastic band and other person providing a resistance force while the strap-like apparatus is secured about the user's waist.

In some embodiments of the method, the first end of a first elastic band is affixed to the fixation point located on the outside surface of the strap-like apparatus, (the center of connecting strap) the second end of the first elastic band comprising an attached handle is held by another person, wherein the user performs resistance running exercises with the elastic band while the strap-like apparatus is secured about the user's waist.

In some embodiments of the method, the first end of a first elastic band is affixed to the fixation point located on the outside surface of the strap-like apparatus, (center of connecting strap) the second end of the first elastic band comprising a quick-release attachment coupling is affixed to an anchoring point of a stationary structure, wherein the user performs resistance running exercises with the elastic band while the strap-like apparatus is secured about the user's body as a bandolier or waist.

In some embodiments of the method, the first end of a first elastic band is affixed to the fixation point located in the lengthwise center of the strap-like apparatus, the second end of the first elastic band comprising an optional handle is held by another person, wherein the user performs resistance running exercises with the elastic band while the strap-like apparatus is secured about the user's body as a bandolier or waist.

In some embodiments of the method, at least a second band is affixed to the fixation point located in outer surface of the first layer of the strap-like apparatus for additional resistance.

In some embodiments of the method, the first end of a first elastic band and the first end of a second elastic band are each affixed to any of the fixation points; the second end of the first elastic band and the second end of the second elastic band each comprising a quick-release attachment coupling are each affixed to an anchoring point of a stationary structure above the user capable of supporting the user's weight, wherein the user can step on the suspended strap-like apparatus, while grasping the stationary structure above the user's head and performing assisted suspension exercises.

Provided herein is a kit for an exercise apparatus comprising a strap-like apparatus adapted to be worn about the user's body, wherein the strap-like apparatus comprises at least a first layer and a second layer, wherein the first layer comprises a first inside surface and a first outside surface and the second layer comprises a second inside surface and a second outside surface; at least one pocket between the first layer and the second layer; a connector strap comprising a first end and a second end and affixed to the outside surface or inside surface of the first layer, wherein the connector strap comprises a coupling mechanism for releasably securing the first end and second end of the connector strap to each other; a first handle and a second handle affixable to the connector strap or directly to an outside surface of the exercise apparatus, wherein each first handle and second handle is spaced approximately equidistant from the lengthwise center of the strap-like apparatus; at least one fixation point affixed to the apparatus; and at least one releasably attachable elastic band.

In some embodiments of the kit, the strap-like apparatus comprises a third layer, wherein the third layer comprises a third inside surface and a third outside surface.

In some embodiments of the kit, the third layer is an extension of the first layer and folds over the second layer to enclose the at least one pocket between the first inside surface and the second inside surface.

In some embodiments of the kit, the layers are formed from a single piece of folded material.

In some embodiments of the kit, the layers are formed from two or more pieces of material and joined along their lengthwise edges.

In some embodiments of the kit, the at least one fixation point is located at the approximate lengthwise center of the connector strap and accessible through an access point in the layers of the strap-like apparatus.

In some embodiments, the kit further comprises a detachable flexible handle; a running parachute; a suspension cord; a suspension harness; a parachute cord; a coupling mechanism; a flexible water canteen; a glove; a drinking tube; a flow valve and one or more of a plurality of safety features.

In some embodiments, the kit further comprises a second fixation point affixed adjacent to a first end of the strap-like apparatus, extending outside of the pocket and a third fixation point affixed adjacent to a second end of the strap-like apparatus, extending outside of the pocket, wherein the second and third fixation points are affixed between the first and second layers and to the connector strap or are affixed directly to the connector strap.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

What is claimed is:

1. An exercise apparatus comprising:

a layered strap adapted to be worn about a user's body, wherein the layered strap comprises at least a first layer and a second layer, wherein the first layer comprises a first inside surface and a first outside surface and the second layer comprises a second inside surface and a second outside surface;

wherein the first layer and the second layer are each folded along a lengthwise edge to form at least one releasably closable pocket between the first layer and the second layer;

a securing mechanism configured to releasably capture and at least partially close the lengthwise edge of the at least one releasably closable pocket;

a connector strap comprising a first end and a second end spaced lengthwise from each other and affixed to the outside surface or inside surface of the first layer, wherein the connector strap comprises a coupling mechanism for releasably securing the first end and second end of the connector strap to each other;

a first handle and a second handle each comprising a hand grip and permanently affixed to the connector strap or an outside surface of any layer of the exercise apparatus, wherein each first handle and second handle is spaced approximately equidistant from a lengthwise center of the layered strap;

a first fixation ring affixed adjacent to a first end of the layered strap, extending outside of the pocket; and a second fixation ring affixed adjacent to a second end of the layered strap, extending outside of the pocket;

wherein the first and second fixation rings are affixed between the first and second layers and to the connector strap or are affixed directly to the connector strap.

2. The exercise apparatus of claim 1, wherein the device comprises a third layer, wherein the third layer comprises a third inside surface and a third outside surface and wherein the third layer is an extension of the first layer and folds over the second layer to enclose the at least one pocket between the first inside surface and the second inside surface.

3. The exercise apparatus of claim 1, further comprising a third fixation ring affixed to the connector strap at the approximate lengthwise center of the layered strap and accessible through at least one access point in the layers of the layered strap.

4. The exercise apparatus of claim 1, wherein the at least one releasably closable pocket is at least partially closable along the lengthwise edge.

5. The exercise apparatus of claim 1, further comprising a fourth fixation ring affixed adjacent to the first end of the layered strap and a fifth fixation ring affixed adjacent to the second end of the layered strap, wherein the fourth and fifth fixation points are affixed between the first and second layers within the at least one pocket and to the connector strap and are accessible from the inside of the at least one pocket.

6. The exercise apparatus of claim 1, wherein the at least one securing mechanism to releasably capture and at least partially close the lengthwise edge or ends of the pocket comprises:

a flap;
a Velcro™ connection;
a compression snap;
a zipper;
a magnet;
a buckle;
a button;
a clasp;
a flexible material strap; or
a hook.

7. The exercise apparatus of claim 1, wherein the at least one pocket is configured to releasably capture and secure an accessory article.

8. The exercise apparatus of claim 1, further comprising a releasably attachable third handle.

9. The exercise apparatus of claim 1, further comprising at least one releasably attachable elastic band.

10. The exercise apparatus of claim 1, wherein the coupling mechanism for releasably securing the ends of the connector strap comprises:

a belt buckle;
a cam buckle;
a Velcro™ attachment;
a Velcro™ hook and loop;
an airline seat buckle;
a side release buckle;
a double loop and belt strap; or
a snap hook and ring.

11. The exercise apparatus of claim 1, further comprising a quick-release attachment coupling comprising:

a carabiner;
a snap hook;
a bolt snap;
a spring snap;
a spring clip;
a harness clip; or
a releasable captured hook;

wherein the quick-release attachment coupling is adapted to couple an accessory article to a fixation ring on said exercise apparatus.

12. The exercise apparatus of claim 9, wherein the at least one releasably attachable elastic band comprises an elastic tension ranging from about: 1.0-5.0 lbs.; 2.0-10.0 lbs.; 5.0-15.0 lbs.; 10.0-20.0 lbs.; 15.0-30.0 lbs.; 20.0-40.0 lbs.; 25.0-50.0 lbs.; 30.0-60.0 lbs.; 35.0-70.0 lbs.; 40.0-80.0 lbs.; 45.0-90.0 lbs.; 50.0-100.0 lbs.; 60.0-120.0 lbs.; 75.0-150.0 lbs.; 100.0-200.0 lbs.; 150.0-250.0 lbs.; 200.0-400.0 lbs.; and from about 1.0-400 lbs.

13. The exercise apparatus of claim 9, wherein the at least one releasably attachable elastic band ranges in length from about: 0.5-2.0 feet, 1.0-2.0 feet, 1.5-2.0 feet; 1.5-3.0 feet; 1.5-4.0 feet; 1.5-5.0 feet; 1.5-6.0 feet; 1.5-7.0 feet; 1.5-8.0 feet; 1.5-9.0 feet; and from about 0.5-10.0 feet.

14. The exercise apparatus of claim 9, wherein the at least one releasably attachable elastic band comprises a protective sleeve.

15. The exercise apparatus of claim 7, wherein an accessory article comprises:

an elastic band;

a non-elastic band;
a detachable flexible handle;
a running parachute;
a suspension cord;
a suspension harness;
a parachute cord;
a coupling mechanism;
a flexible water canteen; or
a glove.

16. The exercise apparatus of claim 1, wherein the layered strap comprises wear-resistant material comprising:
nylon;
moleskin;
polyester;
polypropylene;
aramid polymer fabric;
Kevlar®;
technical fabric;
SuperFabric®;
Cordura®;
Spectra Shield®;
Dyneema®;
Tegris™;
Innegra™;
HB51;
Protech®;
Gold Shield®;
Polyethylene napthalate (PEN);
Vectran®;
UHMWPE;
Twaron®;
Zylon®;
Polyethylenes;
Mylar®;
ABC-Matrix©;
Chlorosulfonated polyethylene; or
leather.

17. A kit for an exercise apparatus comprising:
a layered strap adapted to be worn about a user's body, wherein the layered strap comprises;
at least a first layer and a second layer, wherein the first layer comprises a first inside surface and a first outside surface and the second layer comprises a second inside surface and a second outside surface;
wherein the first layer and the second layer are each folded along a lengthwise edge to form at least one closable pocket between the first layer and the second layer;
a securing mechanism configured to releasably capture and at least partially close the lengthwise edge of the at least one closable pocket;
a connector strap comprising a first end and a second end spaced lengthwise from each other and affixed to the outside surface or inside surface of the first layer, wherein the connector strap comprises a coupling mechanism for releasably securing the first end and second end of the connector strap to each other;
a first handle and a second handle each comprising a hand grip and permanently affixed to the connector strap or directly to an outside surface of the exercise apparatus, wherein each first handle and second handle is spaced approximately equidistant from a lengthwise center of the layered strap;
at least one fixation ring affixed to the apparatus; and
at least one releasably attachable elastic band.

18. The kit of claim 17, further comprising:
a detachable flexible handle;
a running parachute;
a suspension cord;
a suspension harness;
a parachute cord;
a coupling mechanism;
a flexible water canteen;
a glove;
a drinking tube;
a flow valve; or
one or more safety features.

* * * * *